US008950271B2

(12) United States Patent
Fienup et al.

(10) Patent No.: US 8,950,271 B2
(45) Date of Patent: Feb. 10, 2015

(54) MATERIAL DISPENSING SYSTEM AND METHOD WITH CAPACITANCE SENSOR ASSEMBLY

(75) Inventors: William J. Fienup, Chicago, IL (US); Keith Grider, Chicago, IL (US); Sean Corrigan, Chicago, IL (US)

(73) Assignee: Diversey, Inc., Sturtevant, WI (US)

( * ) Notice: Subject to any disclaimer, the term of this patent is extended or adjusted under 35 U.S.C. 154(b) by 450 days.

(21) Appl. No.: 13/318,417

(22) PCT Filed: May 3, 2010

(86) PCT No.: PCT/US2010/033409

§ 371 (c)(1), (2), (4) Date: Nov. 1, 2011

(87) PCT Pub. No.: WO2010/129476

PCT Pub. Date: Nov. 11, 2010

(65) Prior Publication Data

US 2012/0058025 A1 Mar. 8, 2012

Related U.S. Application Data

(60) Provisional application No. 61/176,078, filed on May 6, 2009.

(51) Int. Cl.

| | |
|---|---|
| ***G01F 1/00*** | (2006.01) |
| ***D06F 39/02*** | (2006.01) |
| ***A47L 15/44*** | (2006.01) |

(52) U.S. Cl.

CPC ..... *D06F 39/022* (2013.01); *A47L 15/44* (2013.01)

USPC ..... 73/861

(58) Field of Classification Search

USPC ..... 73/861.79, 304 C; 137/2; 700/282

See application file for complete search history.

(56) References Cited

U.S. PATENT DOCUMENTS

| | | | | |
|---|---|---|---|---|
| 3,523,245 | A | 8/1970 | Love et al. | |
| 4,010,715 | A | 3/1977 | Robar et al. | |
| 4,982,606 | A * | 1/1991 | Adamski et al. | 73/304 C |
| 5,305,916 | A | 4/1994 | Suzuki et al. | |
| 5,929,343 | A | 7/1999 | Yamamoto et al. | |
| 6,112,946 | A * | 9/2000 | Bennett et al. | 221/1 |

(Continued)

FOREIGN PATENT DOCUMENTS

| | | |
|---|---|---|
| GB | 1232675 | 5/1971 |
| GB | 2159125 | 11/1985 |

OTHER PUBLICATIONS

The International Search Report prepared by the Korean Intellectual Property Office—date of completion Dec. 22, 2010.

(Continued)

*Primary Examiner* — Jewel V Thompson

(74) *Attorney, Agent, or Firm* — Michael Best & Friedrich LLP

(57) ABSTRACT

A dispensing system and method for delivering material to a washing device using a capacitance sensor configuration is disclosed. The capacitance sensor configuration allows a controller to monitor and determine a flow rate of fluid exiting a reservoir. The dispensing system uses the flow rate information, along with downstream conductivity information, to control the dispensing of material. Additionally, one or more error conditions are identified during the material delivery cycle based at least partially on the monitored conductivity and capacitance.

19 Claims, 10 Drawing Sheets

(56) References Cited

U.S. PATENT DOCUMENTS

| | | | | |
|---|---|---|---|---|
| 7,004,356 | B1 | 2/2006 | Sayers et al. | |
| 7,028,561 | B2 * | 4/2006 | Robertson et al. | 73/861.79 |
| 8,380,355 | B2 * | 2/2013 | Mayleben et al. | 700/282 |
| 2001/0042761 | A1 | 11/2001 | Ophardt et al. | |
| 2008/0282898 | A1 * | 11/2008 | Knepler | 99/285 |

OTHER PUBLICATIONS

EP10772649.9 Extended European Search Report and Written Opinion dated Mar. 21, 2014 (5 pages).

* cited by examiner

MATERIAL DISPENSING SYSTEM AND METHOD WITH CAPACITANCE SENSOR ASSEMBLY

BACKGROUND

The invention generally relates to material dispensing systems. More specifically, the invention relates to methods and systems of monitoring and controlling material dispensing systems.

As washing machines (e.g. dish washing machines, clothes washing machines, etc.) have become more sophisticated, systems have been implemented to automatically feed such machines with detergents, sanitizers, and/or rinse aids, which may be produced in liquid, condensed, compressed, granulated, and/or powdered form. Such materials may be automatically delivered to a variety of types of washing machines.

SUMMARY

In one embodiment, the invention provides a capacitance sensor assembly for determining flow rate. The capacitance sensor assembly includes a reservoir, a capacitance sensor, and a controller. The reservoir includes an input passage, at least one retaining wall with at least one opening, and a fluid pooling area. Fluid is received into the fluid pooling area via the input passage and exits the fluid pooling area through the at least one opening. The capacitance sensor is positioned within the fluid pooling area and includes a capacitance level output operable to output a capacitance level signal indicative of a capacitance within the fluid pooling area. The controller includes a capacitance level input module coupled to the capacitance level output and operable to receive the capacitance level signal. The controller also includes a flow rate module operable to indicate a flow rate of fluid exiting through the at least one opening based on the capacitance level signal and the opening size.

In another embodiment, the invention provides a dispensing system for a washing device including a fluid supply passage, a reservoir coupled to and downstream from the fluid supply passage, and a capacitance sensor operable to indicate a capacitance level within the reservoir. The dispensing system further includes a dispenser coupled to and downstream from the reservoir, wherein the dispenser includes a dispensing opening, an output passage coupled to and downstream from the dispenser, a conductivity sensor operable to indicate a conductivity level within the output passage, and a controller. The controller is electrically coupled to the capacitance sensor, the dispenser, and the conductivity sensor. Furthermore, the controller is operable to determine a fluid flow rate based on the capacitance level within the reservoir, to cause the dispenser to dispense a first material through the dispensing opening based on a comparison of the fluid flow rate and a flow rate threshold, and to indicate an error condition. The error condition may be based on at least one of the comparison of the fluid flow rate and a flow rate threshold and a comparison of the conductivity level and a first conductivity level threshold.

In another embodiment, the invention provides a dispensing system for delivering a material to a receiving component positioned downstream of the dispensing system. The dispensing system including a receptacle, a valve, a controller, a material metering device configured to dispense material into the receptacle, and a sensor positioned upstream from the receptacle and configured to generate a first signal indicative of capacitance. The valve is configured to control a supply of water to the receptacle, the valve having an off position that prevents water from entering the receptacle and a first on position that allows water to enter the receptacle. The controller is configured to receive the first signal from the sensor and to generate a valve control signal and a material metering device control signal. The valve control signal is operable to toggle the valve between the first on position and the off position. The material metering device control signal is operable to initiate a dispensing of the material. The valve control signal and the material metering device signal are generated at least partially in response to a comparison by the controller of the first signal to one or more stored capacitance threshold values.

Other aspects of the invention will become apparent by consideration of the detailed description and accompanying drawings.

DETAILED DESCRIPTION

Figure 1:
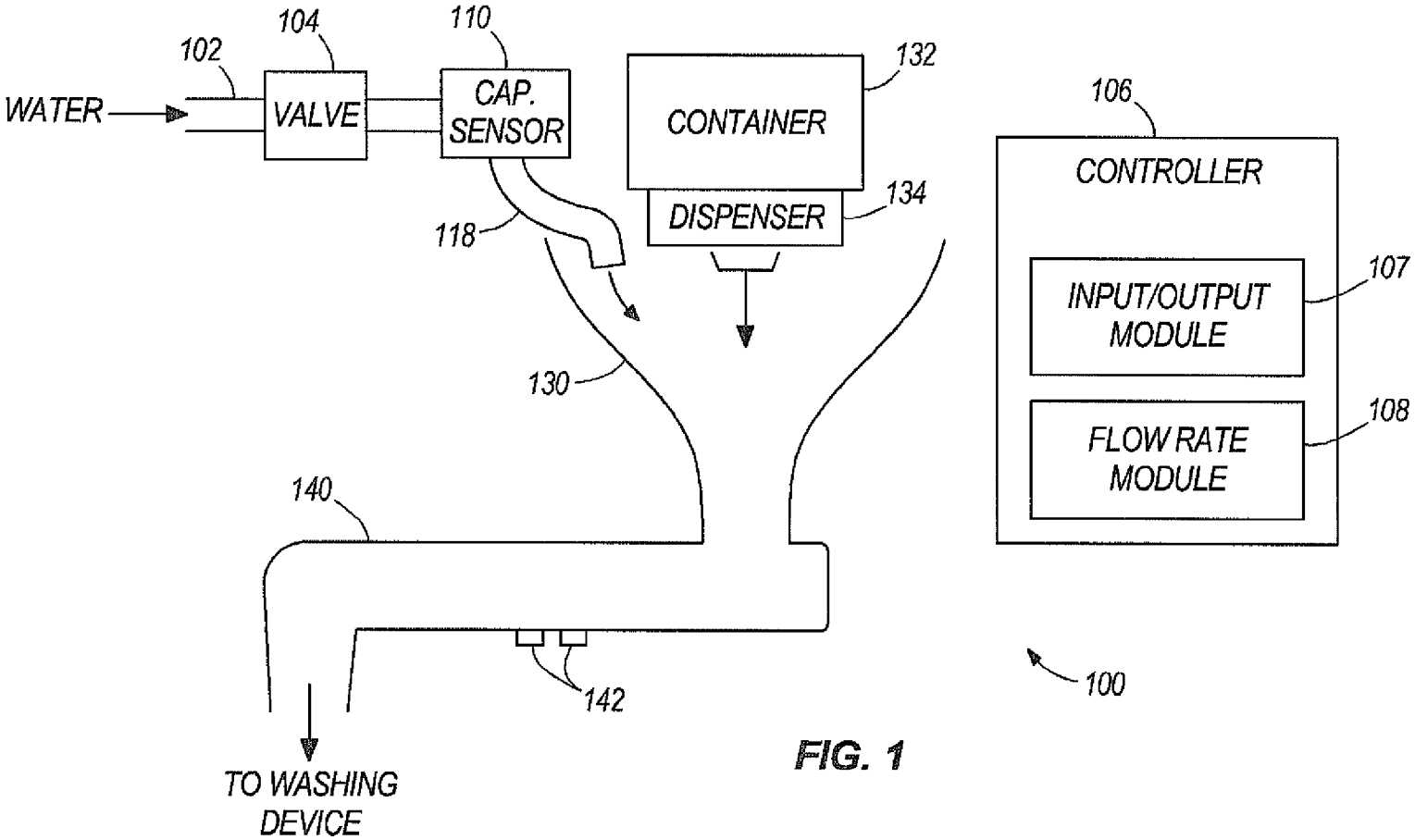
FIG. 1 illustrates an exemplary dispensing system according to an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

As should also be apparent to one of ordinary skill in the art, the systems shown in the figures are models of what actual systems might be like. Many of the modules and logical structures described are capable of being implemented in software executed by a microprocessor or a similar device or of being implemented in hardware using a variety of components including, for example, application specific integrated circuits ("ASICs"). Terms like "controller" may include or refer to both hardware and/or software. Furthermore, throughout the specification capitalized terms are used. Such terms are used to conform to common practices and to help correlate the description with the coding examples, equations, and/or drawings. However, no specific meaning is implied or should be inferred simply due to the use of capitalization. Thus, the claims should not be limited to the specific examples or terminology or to any specific hardware or software implementation or combination of software or hardware.

Embodiments of the invention provide methods and systems of monitoring and controlling material dispensing systems that automatically, accurately, and efficiently, deliver material to a variety of types of washing machines. For instance, a capacitance sensor assembly improves the ability of a dispensing system to monitor the flow of water or fluid through the dispensing system. In particular, water may be filtered or distilled to the point where a conductivity sensor's ability to detect water is degraded or ineffective. Use of the capacitance sensor of the present invention advantageously results in water and flow rate detection that is less affected than other types of sensors by water's ionization level, softness level, and amount of filtering (e.g., by reverse osmosis or other processes).

In addition, embodiments of the capacitance sensor assembly provide beneficial information to a control system for a dispensing system beyond the detection of water. For instance, the capacitance sensor assembly output signals can be used to determine the flow rate of water through the capacitance sensor assembly. Thus, the control system more accurately determines when to dispense material, the quantity of material to dispense, and when an error condition is present.

FIG. 1 depicts components of one exemplary embodiment of a dispensing system 100 for a downstream washing device. A controller 106 is used to monitor and control the dispensing system 100. The controller 106 includes an input/output module 107 and a flow rate module 108. The controller 106 is electrically coupled via the input/output module 107 to the solenoid valve 104, capacitance sensor assembly 110, dispenser 134, and conductivity sensor 142. Using the input/output module 107, the controller 106 receives measurements from the capacitance sensor assembly 110 and conductivity sensor 142, and outputs control signals to the solenoid valve 104 and dispenser 134. The water intake conduit 102 is coupled to a solenoid valve 104 controlled by the controller 106. The water intake conduit 102 and solenoid valve 104 are used to introduce water into the dispensing system 100. For example, in some embodiments, when the solenoid valve 104 is energized, water from the water intake conduit 102 is allowed to enter the dispensing system 100. Alternatively, when the solenoid valve 104 is de-energized, water is prevented from entering the dispensing system 100. In other embodiments, a valve mechanism other than the solenoid valve 104 may be used.

When the solenoid valve 104 is set to allow water to flow into the dispensing system 100, water flows into the capacitance sensor assembly 110. The capacitance sensor assembly 110 is configured to measure a capacitance level of the contents (e.g., air and/or water) therein and to output a signal indicative of the capacitance level to the input/output module 107 of the controller 106. This capacitance level is indicative of the amount of water within the capacitance sensor assembly 110, which can be used by the flow rate module 108 to determine the flow rate of the water. An exemplary capacitance sensor assembly 110 is shown in more detail in FIG. 4A. Water flowing into the capacitance sensor assembly 110 from the water intake conduit 102 proceeds to flow into the water channel 118.

The funnel 130 receives water flowing out of the water channel 118 in addition to material dispensed from the container 132 by the dispenser 134. As will be explained in further detail below, the dispenser 134 is controlled by the controller 106 to dispense a particular amount of material from the container 132 at particular instances.

The channel 140 is fluidly coupled to the funnel 130 to receive the contents of the funnel 130. The downstream washing device (not shown) is fluidly coupled to the channel 140 to receive the contents of the channel 140. The conductivity sensor 142 is attached to the channel 140 to measure the conductivity of the contents of the channel 140. If no water or dispensing material is in the channel 140, the conductivity sensor 142 will measure and output a low conductivity level. If only water is present in the channel 140, the conductivity sensor 142 will measure and output a higher conductivity level than if no water or material is present. If a combination of water and a dispensed material from container 132 is present in the channel 140, the conductivity sensor 142 will measure and output a conductivity level that is higher than both the empty channel 140 and water-only channel 140 conductivity levels. Water that has been deionized or filtered (e.g., by reverse osmosis) may not be detected by the conductivity sensor 142. When the conductivity sensor 142 cannot properly detect water, the capacitance sensor assembly 110 can be relied upon to ensure proper flow rate of water entering the funnel 130. While a conductivity sensor 142 is present in this embodiment of the invention, other embodiments do not include a conductivity sensor.

Figure 2:
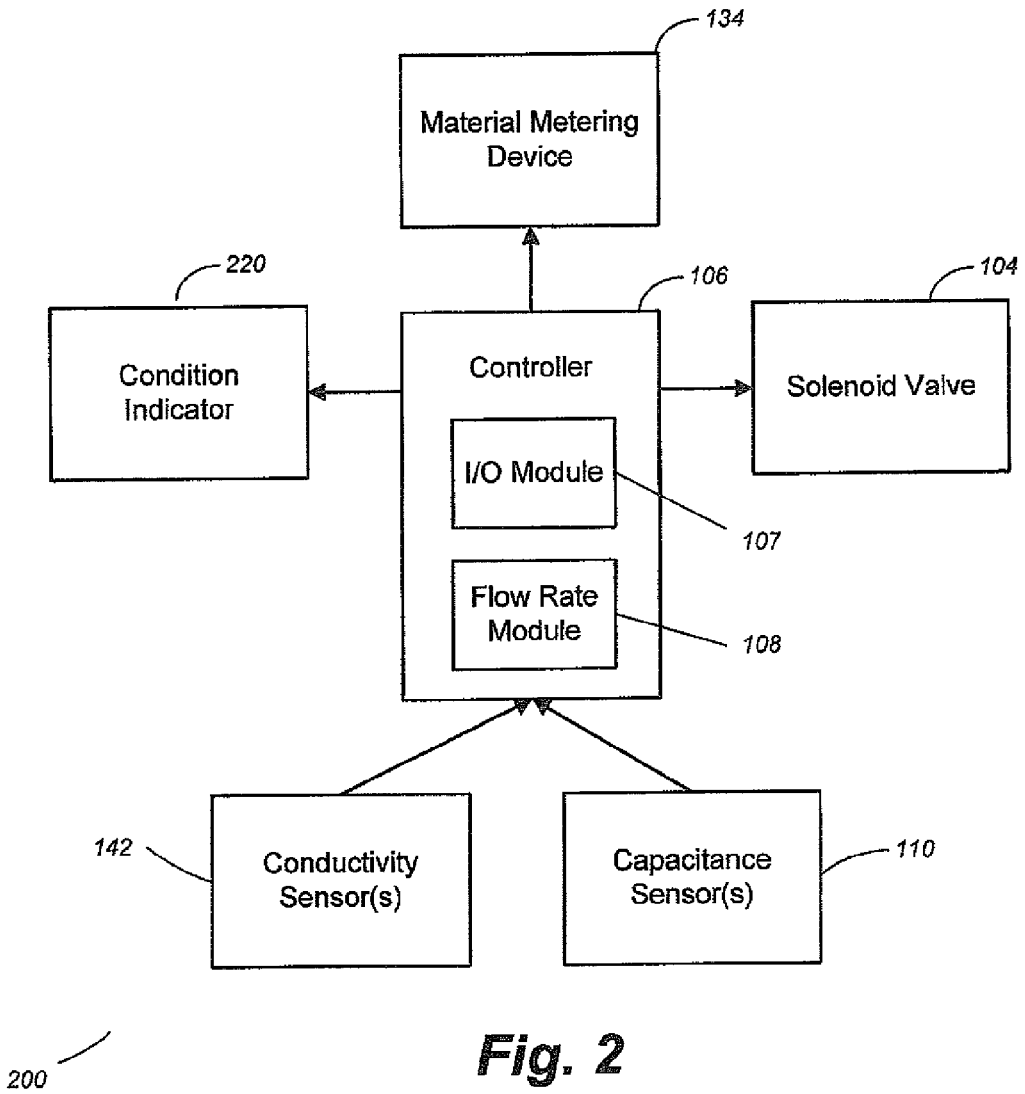
FIG. 2 is a block diagram of an exemplary control system according to an embodiment of the invention.

FIG. 2 is a block diagram of an exemplary control system 200. In some embodiments, the control system 200 can be used, for example, to control the components described with respect to the dispensing system shown in FIG. 1. Generally, the control system 200 utilizes a controller 106 to operate a solenoid valve 104, a material metering device 134, and a dispensing system condition indicator 220. Additionally, the controller 106 receives information from the conductivity sensor 142 and the capacitance sensor assembly 110. The controller 106 may communicate with, control, and receive signals with other components via the input/output module 107.

Generally, the controller 106 is a suitable electronic device, such as, for example, a programmable logic controller ("PLC"), a personal computer ("PC"), and/or other industrial/personal computing device. As such, the controller 106 may include both hardware and software components, and is meant to broadly encompass the combination of such components. In some embodiments, the solenoid valve 104 is a normally closed valve that opens when energized, which occurs when the controller 106 transmits a signal to the solenoid valve 104 to open the solenoid valve 104. The material metering device 134 is used to control the amount of material that is dispensed from a container. Similar to the solenoid valve 104, the metering device 134 is controlled via a signal from the controller 106. The condition indicator 220 can include one or more visual and/or audible indicators (e.g., a light, a liquid crystal display ("LCD") unit, a horn, etc.) to indicate to a user a condition of the dispensing system (e.g., as described with respect to FIG. 6).

In some embodiments, the conductivity sensor 142 is an analog conductivity sensor that transmits a variable signal (e.g., a 0-10 volt signal, a 0-10 milliamp signal, etc.) to the controller 106 that is indicative of the conductivity of the area surrounding the sensor 142. In some embodiments, the capacitance sensor assembly 110 is an analog capacitance sensor that transmits a variable signal (e.g., a 0-10 volt signal, a 0-10 milliamp signal, etc.) to the controller 106 that is indicative of the capacitance level of the area surrounding the capacitance sensor assembly 110. The flow rate module 108 of the controller 106 can use the capacitance level signal, in conjunction with other known variables, to determine the flow rate of water out of the area surrounding the capacitance sensor assembly 110.

In operation, generally, the controller 106 utilizes the information from the sensors 142 and 110 to determine how to control the solenoid valve 104, the metering device 134, and the dispensing system condition indicator 220. For example, in some embodiments, during a material delivery cycle (e.g., a cycle in which one or more doses of material are dispensed), the controller 106 initially transmits a signal to the solenoid valve 104 to energize the solenoid valve 104. Once energized, the solenoid valve 104 allows water to flow. This initial influx of water can be referred to as a pre-flush. Additionally, the controller 106 receives capacitance information via a signal from the capacitance sensor assembly 110 and conductivity information via a signal from the conductivity sensor 142. The controller 106 utilizes the capacitance and conductivity information to determine whether to dispense one or more doses of material into the flowing water. If the controller 106 determines not to dispense the material, for instance, because the capacitance sensor assembly 110 or conductivity sensor 142 indicates that no water or a low amount of water is present, the controller 106 may generate a dispensing error condition signal. The dispensing error condition signal is transmitted to the condition indicator 220, which then indicates the error.

After dosing, the controller 106 keeps the solenoid valve 104 energized to allow the flowing water to clear away the delivered material. This water flow after dosing can be referred to as a post-flush. Following and/or during the post-flush, the controller 106 also uses the capacitance information from the capacitance sensor assembly 110 to verify the water flow rate and uses conductivity information from the conductivity sensor 142 to verify that the material was properly administered and/or received by downstream components. If the controller 106 determines that the material was not properly administered and/or received by downstream components, or that the water flow rate is incorrect, the controller 106 may generate a dispensing error condition signal that is transmitted to the condition indicator 220, which then indicates the error.

In some embodiments, the control system 200 may include an input device that allows a user to input and control one or more user-changeable settings. For example, a user may use the input device to enter a material amount (e.g., a number of doses to deliver), a length and/or amount of pre-flush, and a length and/or amount of post-flush. In some embodiments, for example, the pre-flush is adjustable between approximately 1.5 and 5 seconds in duration and the post-flush is adjustable between approximately 2 and 10 seconds in duration. Additionally, a user may enter one or more conductivity thresholds and/or capacitance thresholds, which the controller 106 can store and use to decide whether to deliver the material.

In some embodiments, the control system 200 does not include a conductivity sensor 142 and relies on a closed-loop feedback system involving the capacitance sensor assembly 110. In such embodiments, the valve is opened or closed to maintain a desired flow rate as measured by the capacitance sensor assembly 110. In other embodiments, the control system 200 may contain more components than those shown in FIG. 2. In one embodiment, the control system 200 includes multiple sensors for measuring conductivity at different locations in a dispensing system. For example, a downstream sensor can be added to the control system 200 that measures the conductivity of the water/material solution after the solution has exited the channel 140 (e.g., in a clothes or dish washing machine). In another embodiment, the control system 200 may include a communication device that allows the control system 200 to communicate with other systems. For example, in some embodiments, the control system 200 tracks the amount of material that is available to be dispensed, and transmit a notification signal to another system when the material level is low. The control system 200 may also transmit operational information (e.g., dosage amount, length of pre-flush and post-flush, dispensing system errors, etc.) to one or more other systems (e.g., a central control system). Additionally, the control system 200 may be operated by another system via the communication system.

In some embodiments, the controller 106 may generate a dispensing error condition signal for reasons other than those described above. For example, in embodiments that include more than one sensor (e.g., one capacitance sensor assembly 110 positioned proximate to a water intake conduit and one conductivity sensor 142 positioned near an outlet conduit), the controller 106 may generate a dispensing error condition signal if the signals from the sensors are not consistent. For example, if the capacitance sensor assembly 110 that is proximate to the water intake conduit indicates that water is flowing, but the conductivity sensor 142 that is proximate to the outlet conduit does not indicate that water is present, a dispensing error condition may be identified. In another embodiment, an error condition signal may be generated if a problem with the communication system is identified (e.g., the communication system is unable to transmit information to other systems).

Figure 3:
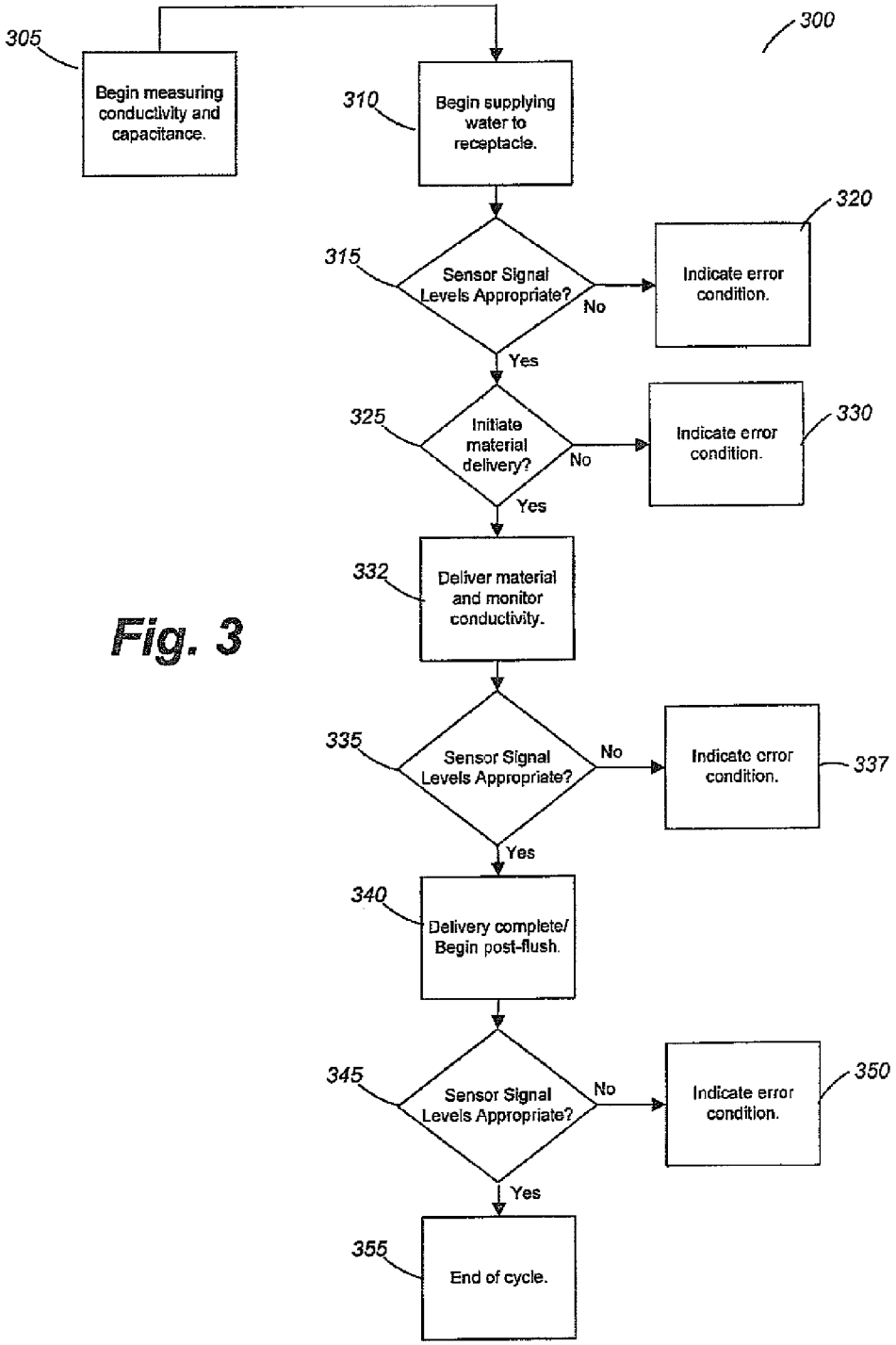
FIG. 3 illustrates an exemplary process for controlling operations of a dispensing system according to an embodiment of the invention.

FIG. 3 illustrates a process 300 for controlling the operations of a dispensing system (e.g., the dispensing system 100) using a control system (e.g., the control system 200) during a material delivery cycle. In some embodiments, the process 300 can also be used to verify that a material has been properly delivered, as well as provide an indication of how much material has been delivered. While the process 300 is described as being carried out by the components included in the dispensing system 100 and/or the control system 200, in other embodiments, the process 300 can be applied to other systems. In some embodiments, the process 300 is performed multiple times to effect one complete washing cycle of the washing device. For instance, process 300 may be performed once for dispensing detergent material, once for dispensing sanitizer material, and once for dispensing rinse aid material.

The first step in the process 300 is to begin measuring capacitance in the capacitance sensor assembly 110 and conductivity in the conductivity sensor 142 (step 305) by initializing each sensor. In some embodiments, the capacitance sensor assembly 110 and/or conductivity sensor 142 are in constant operation, generating and transmitting signals indicative of capacitance or conductivity to the controller 106, and do not need to be initialized. In some embodiments, the controller 106 uses the capacitance level signal to determine a water flow rate exiting the capacitance sensor assembly 110 into the water channel 118. Next, water is supplied to the funnel 130 for a pre-flush operation (step 310), and a change in conductivity and capacitance is verified (step 315). For example, the controller 106 verifies that the conductivity monitored by the conductivity sensor 142 changes and the capacitance monitored by the capacitance sensor assembly 110 changes when water is added. The controller 106 can verify or determine that the conductivity changes are appropriate by comparing the conductivity signal from the sensor 142 to a stored set of conductivity thresholds. The controller 106 can verify or determine that the capacitance changes are appropriate by comparing the capacitance signal from the capacitance sensor assembly 110 to a stored set of capacitance thresholds.

The comparison of conductivity values to conductivity thresholds and capacitance values to capacitance thresholds can also aid in determining whether a dispensing error condition is present. For example, if the conductivity that is monitored by the conductivity sensor 142 does not change in accordance with bounds or thresholds set in the controller 106 pertaining to a material delivery cycle, a dispensing error condition may be indicated (e.g., displayed by the condition indicator 220) (step 320). Additionally in step 320, if the capacitance level that is monitored by the capacitance sensor assembly 110 does not change in accordance with bounds or thresholds set in the controller 106 pertaining to a material delivery cycle, a dispensing error condition may be indicated (e.g., displayed by the condition indicator 220). For example, in some embodiments, the condition indicator 220 indicates a dispensing error condition using an array of lights (e.g., as described with respect to FIG. 6). In another embodiment, as previously described, the condition indicator 220 indicates a dispensing error condition using an LCD unit or similar visual device. Additionally or alternatively, an audible alarm may be used to indicate a dispensing error condition, or a message may be sent. As described in greater detail below, dispensing error conditions may include a "no water" condition, a "blocked funnel" condition, or an "out of product" condition. Other dispensing error conditions are also possible (e.g., a "drive failure" condition, a "solenoid valve failure" condition, etc.)

Referring still to FIG. 3, if the conductivity monitored by the conductivity sensor 142 changes in accordance with the thresholds set in the controller 106 and the flow rate determined by the controller 106 using the capacitance level signal from the capacitance sensor assembly 110 is maintained between thresholds set in the controller 106, the controller 106 then determines whether to dispense one or more doses of material (step 325). If the controller 106 determines not to dispense the material, a dispensing error condition may be indicated (step 330). Such a determination may be made, for example, if there is a change in conductivity monitored by the sensor 142, but the change is not consistent with certain conductivity thresholds. Another such determination may be made if, for example, using the capacitance sensor assembly 110, the controller 106 determines that the flow rate is below a low level threshold or above a high level threshold set in the controller 106.

If the controller 106 determines to dispense one or more doses of material, such doses are dispensed (step 332), and the next step in the process 300 is to determine if the conductivity monitored by the sensor 142 changes appropriately after dosing (step 335). If the change in conductivity is not appropriate, or there is no change in conductivity, a dispensing error condition may be indicated (step 337). The capacitance sensor assembly 110 is also monitored in step 335 to determine if the water flow rate drops below a low level threshold or rises above a high level threshold set in the controller 106. If the flow rate is too high or too low relative to the thresholds, a dispensing error condition may be indicated as well (step 337).

If the conductivity change is appropriate and the flow rate is appropriate, delivery of the material is completed and a post-flush operation is initiated (step 340), and a final conductivity change is verified and water flow rate is verified (step 345). If the final change in conductivity is not appropriate, or there is no change in conductivity, a dispensing error condition may be indicated (step 350). If the water flow rate drops below a low level threshold or rises above a high level threshold set in the controller 106, a dispensing error condition may be indicated as well (step 350). If the change in conductivity and the water flow rate is appropriate, the process 300 ends (step 355), and the material delivery cycle is complete. Upon completion, the controller 106 can determine or verify that the material has been properly delivered. The controller 106 can also determine how much material was delivered by determining how many doses were delivered (e.g., see step 332). The process 300 is completed each time a material delivery cycle is initiated.

In other embodiments, an alternative process may be used to deliver the material to the washing device. For instance, if the controller 106 determines in a flow rate verification step (e.g., steps 315, 335, or 345) that the flow rate is above a high threshold or below a low threshold, the controller 106, instead of initiating an error condition, may adjust the solenoid valve to alter the flow rate to be within an acceptable range. The controller 106 can perform this adjustment by, for example, further closing or further opening the solenoid valve 104. Furthermore, in some embodiments, conductivity or capacitance may be verified at additional points during the process. For instance, an additional capacitance sensor assembly 110 may be placed just after the channel 140 output, but before the washing device input (not shown), to determine the output flow rate of fluid. Additionally or alternatively, other parameters may be monitored (e.g., material weight, inductance, turbidity, etc.) and used to determine if one or more doses of material should be delivered and/or if the doses were properly received.

Figure 4A:
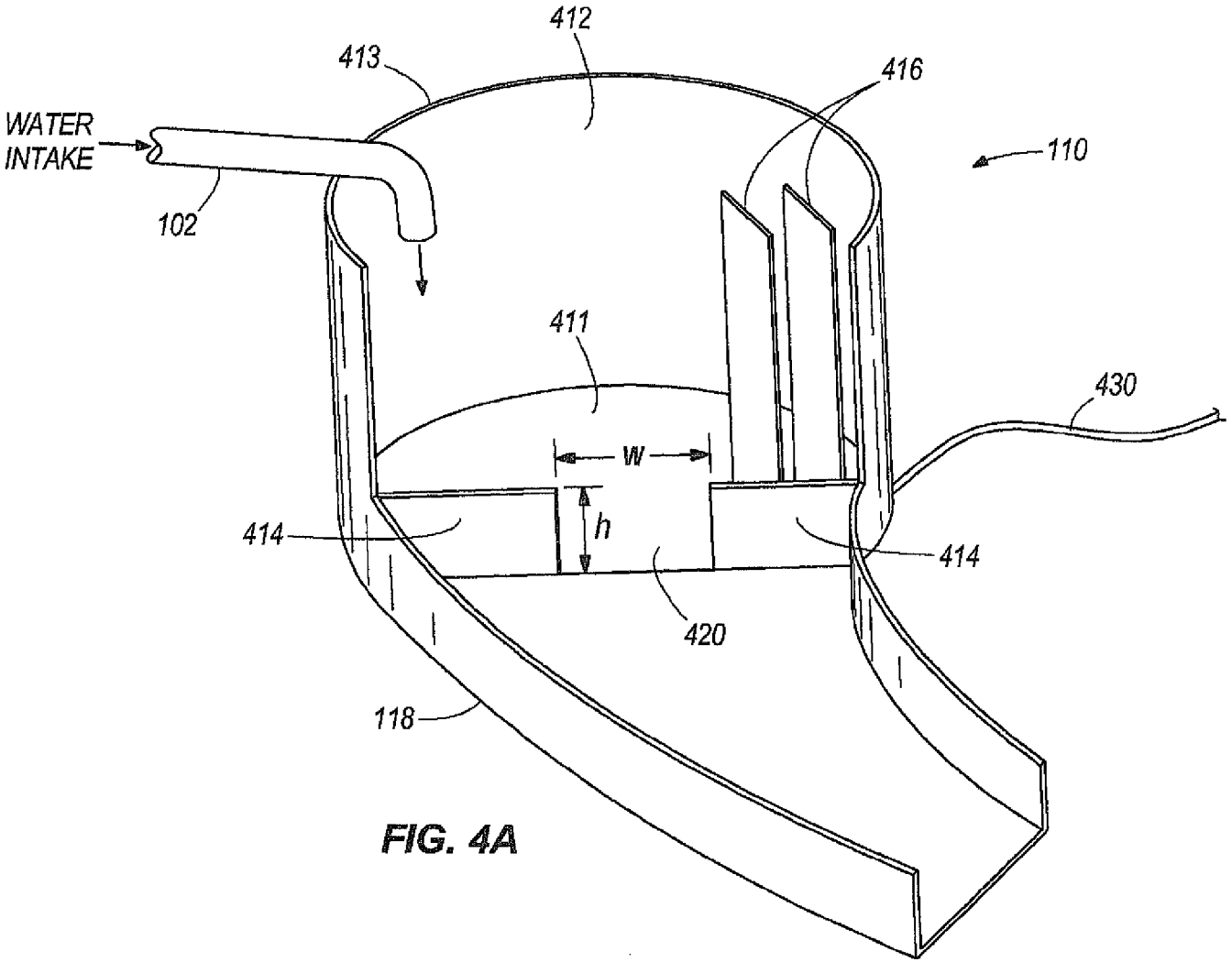
FIG. 4A illustrates an exemplary capacitance sensor assembly according to an embodiment of the invention.

One embodiment of the capacitance sensor assembly 110 of FIG. 1 will be described in further detail with respect to FIG. 4A. In FIG. 4A, the capacitance sensor assembly 110 includes a reservoir 412 formed by a base 411 and retaining walls 413 and 414. Although base 411, retaining walls 413 and 414, and water channel 118 are separately labeled, they may be a single unitary construction or formed from a plurality of pieces. Two parallel plates are positioned within the reservoir 412 to form a capacitance sensor 416. The capacitance sensor assembly 110 includes an input/output connector 430 to be electrically coupled to a controller 106 to indicate a measured capacitance level. The retaining wall 414 has an opening 420 with a known size that fluidly couples the reservoir 412 to the water channel 118. The opening 420 may also be referred to as a weir. The water flowing into the reservoir 412 from a water intake conduit 102 proceeds to flow out of the reservoir 412 via an opening 420 into the water channel 118. In one embodiment, the opening 420 has a rectangular shape with a height h and width w. An alternative opening shape and/or multiple openings can also be used in other embodiments. Although the reservoir 412 is shown to have a partially circular base 411, other constructions are possible in other embodiments. For example, a rectangular base or other base shape may be used. Furthermore, the base 411 and retaining walls 413 and 414 need not intersect perpendicularly. The base 411 may be attached to the retaining walls 413 and 414 at an angle generally sloping towards the opening 420 to encourage water to flow towards the opening 420.

The controller 106 of FIG. 1 can calculate the flow rate of water exiting the reservoir 412 to the water channel 118 using the capacitance measurement of the capacitance sensor 416 sent via the input/output connector 430. As water flows into the reservoir 412, particularly when the incoming flow rate is greater than the amount of water flowing out of the opening 420, water will pool behind the retaining walls 413 and 414. The capacitance sensor 416 measures and outputs the capacitance level between its two parallel plates. An increase in capacitance measured by the capacitance sensor 416 indicates an increase in the water level within the reservoir 412. As the water level increases, the flow rate of water exiting the reservoir 412 via the opening 420 increases. In one embodiment, a database stored in a memory of the controller 106 includes previously measured or estimated flow rates based on fluid levels within the reservoir 412, and the flow rate module 108 uses capacitance levels as index values to reference the associated flow rates. In another embodiment, the controller 106 can be preset or receive as user input the dimensions of the reservoir 412, including the base wall 411, the retaining walls 413 and 414, and the opening 420. Thereafter, the flow rate module 108 calculates the flow rate of water exiting the reservoir 412 to the water channel 118 using the capacitance measurement of the capacitance sensor 416 and the known dimensions of the reservoir 412.

In the embodiment shown in FIG. 4A, the parallel plates of the capacitance sensor 416 extend down to contact the base 411. In this embodiment, the capacitance sensor 416 outputs a capacitance level that increases as the water level rises in the reservoir 412. In another embodiment, the parallel plates of the capacitance sensor 416 do not extend down to contact the base 411. Rather, the parallel plates are attached to the retaining wall 412, to a cover portion that is atop the retaining wall 412, or to another securing means, such that the bottoms of the parallel plates are floating above the base 411. The floating height is chosen such that when the water level reaches the bottom of the parallel plates, the minimum necessary flow rate is reached. The capacitance sensor 416 will output at least two capacitance levels: a first capacitance level indicating that only air is between the parallel plates and a second capacitance level indicating that water is between the parallel plates (i.e., the water level has reached the bottom of the parallel plates). As such, the capacitance sensor assembly 110 operates as a "go/no-go" gauge that informs the control system 200 whether the minimum water flow rate is met.

To calculate the flow rate exiting the capacitance sensor assembly 110 based on the height of the water level therein, the following equation and variables may be used:

$$Q=0.66\times cB\times(2g)^{0.66}\times H^{1.5}$$

Q=water flow rate ($m^3$/sec)

B=width of the opening 420 (m)

c=discharge coefficient g=gravitational constant ($m/s^2$)

H=height of the water over the opening 420, measured behind the opening 420 edge (m)

In one embodiment, the discharge coefficient (c) can have a value of approximately 0.62. The gravitational constant (g) can have a value of approximately 9.81 $m/s^2$. If the area behind the opening 420 where water pools is narrower than the width of the opening 420, the equation for B becomes: B=width of the opening 420−(0.2×H). The area behind the opening 420 where water pools in FIG. 4A, however, is wider than the width of the opening 420. Thus, no adjustments to the value of B are required for flow rate calculations of the capacitance sensor assembly 110 depicted in FIG. 4.

Figure 4B:
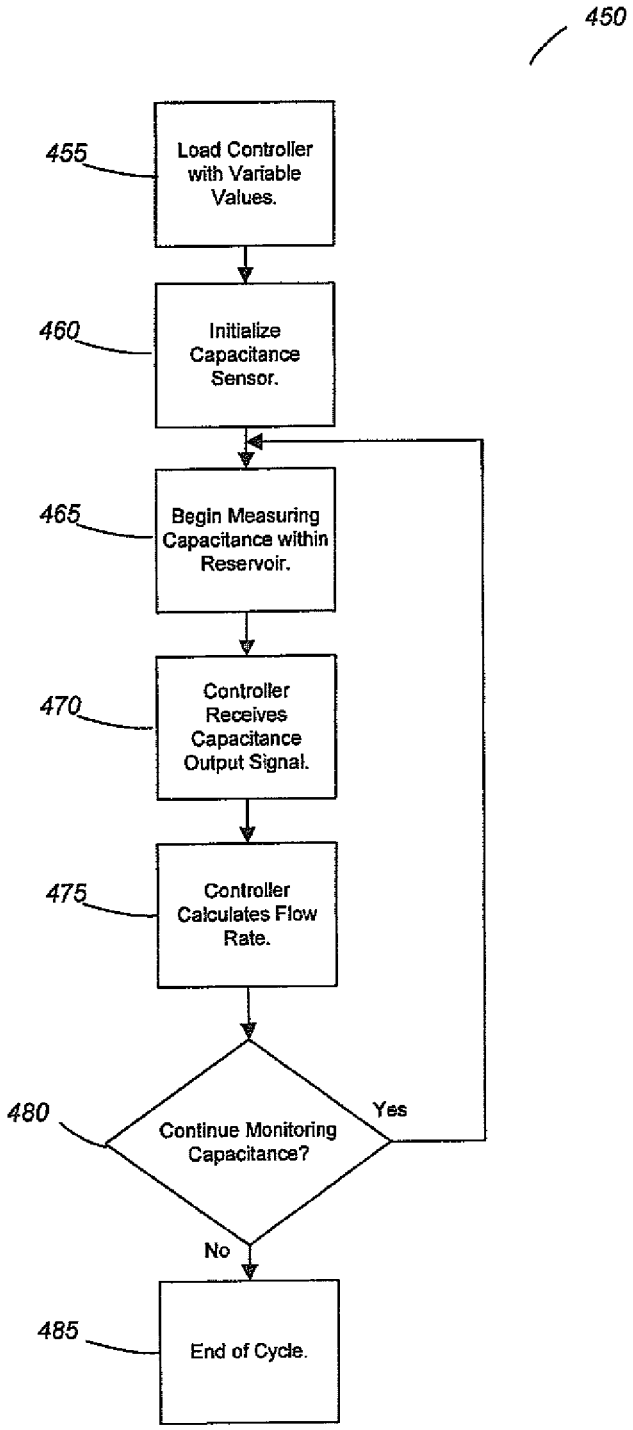
FIG. 4B illustrates an exemplary process for controlling operations of a capacitance sensor assembly according to an embodiment of the invention.

A method of operation of the capacitance sensor assembly 110 of FIG. 4A will be described in further detail with respect to FIGS. 4B and 5A-5D. FIG. 4B illustrates a process 450 for controlling the operations of a capacitance sensor assembly system (the capacitance sensor assembly 110 of FIG. 4A). While the process 450 is described as being carried out by the components included in the capacitance sensor assembly 110, in other embodiments, the process 300 can be applied to other systems.

The first step in the process 450 is to load the controller 106 with the appropriate known variable values. For instance, variable values to load may include reservoir 412 dimensions and capacitance threshold values. Next, in step 460, the controller 106 initializes the capacitance sensor 416, if the capacitance sensor is of the type requiring initialization. In some embodiments, the capacitance sensor 416 continuously outputs signals indicative of a capacitance level without the need for initialization. Thereafter, the capacitance sensor 416 measures the capacitance within the reservoir 412 and outputs values to the controller 106 (step 465). The capacitance within the reservoir 412 is indicative of the water level therein. The controller 106 then receives the capacitance signals and calculates the flow rate of fluid exiting the reservoir 412 (step 475). In step 480, the controller 106 determines whether to continue to monitor the capacitance level within the reservoir 412 and calculate the flow rate. If the controller 106 determines to continue monitoring and calculating, the process returns to step 465. Otherwise, the process ends at step 485.

Figure 5A:
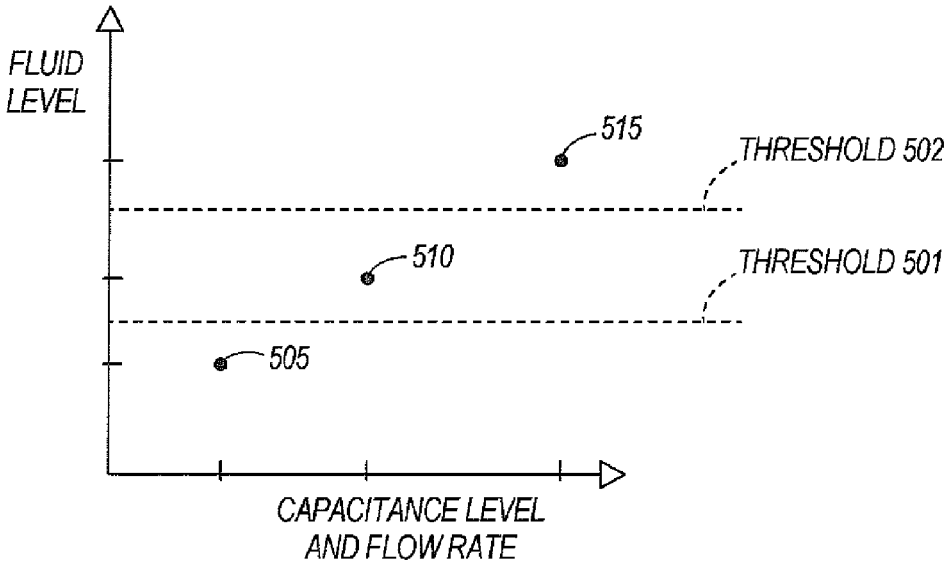
FIGS. 5A-D illustrate an exemplary operation of a capacitance sensor assembly according to an embodiment of the invention.

FIG. 5A includes a graph 500 showing the relationship between (1) the fluid level within the reservoir 412 and (2) the capacitance level signal output by the capacitance sensor 416 and the fluid flow rate exiting the reservoir 412. Three points, 505, 510, and 515, are displayed on the graph 500. The three points depict that, as the fluid level in the reservoir increases, both the capacitance level indicated by the capacitance sensor 416 and the determined fluid flow rate out of the reservoir 412 also increase.

Figure 5B:
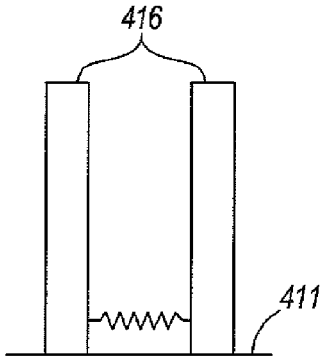
Figure 5C:
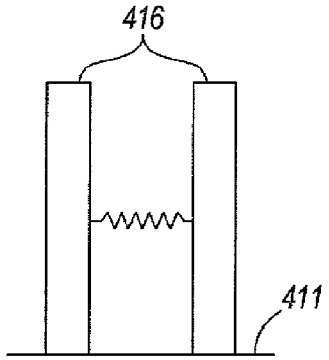
Figure 5D:
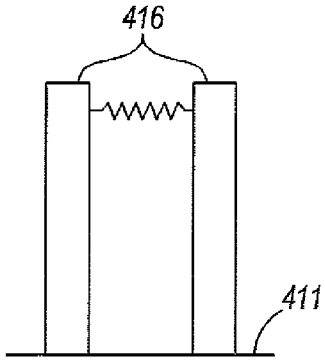

An exemplary low flow rate threshold 501 and high flow rate threshold 502 are also depicted in FIG. 5A. Thresholds 501 and 502 may be stored in the controller 106 and used in the process of FIG. 3 to determine if the flow rate of water exiting the capacitance sensor assembly 110 is appropriate. FIG. 5B depicts the capacitance sensor 416 and reservoir base 411 where too little fluid is flowing through the capacitance sensor assembly 110. This low-fluid scenario is graphically depicted as point 505 in FIG. 5A. FIG. 5C depicts the capacitance sensor 416 and reservoir base 411 where an appropriate level of fluid is flowing through the capacitance sensor assembly 110. This scenario is graphically depicted as point 510 in FIG. 5A. FIG. 5D depicts the capacitance sensor 416 and reservoir base 411 where too much fluid is flowing through the capacitance sensor assembly 110. This scenario is graphically depicted as point 515 in FIG. 5A.

Although only two thresholds are shown in FIG. 5A, the controller 106 may have more thresholds stored such that different high and low thresholds are used, for instance, at each stage in the process of FIG. 3 being performed. For instance, in one embodiment, a lower pre-flush flow rate relative to the post-flush flow rate may be desired; thus, the high and low flow rate thresholds are lower for the pre-flush operation than for the post-flush operation.

Figure 6:
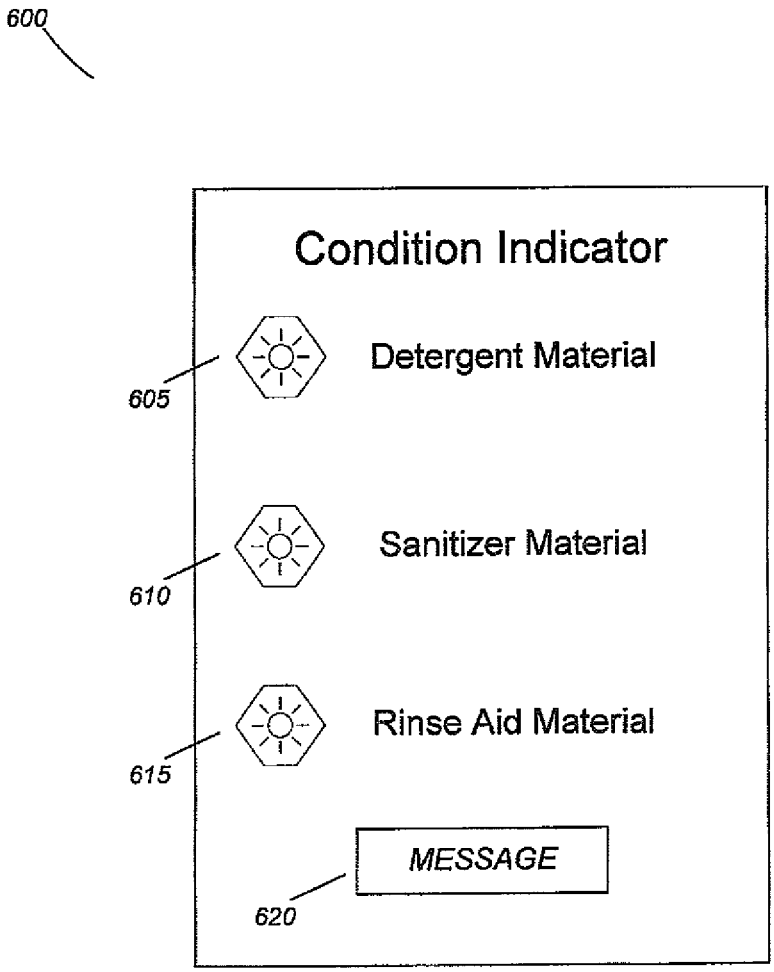
FIG. 6 illustrates an exemplary embodiment of a condition indicator according to an embodiment of the invention.

FIG. 6 illustrates an exemplary embodiment of a condition indicator 600 for a dispensing system, such as the dispensing system 100, that includes three materials (e.g., a detergent material, a sanitizer material, and a rinse aid material). In other embodiment, the condition indicator 600 may be adapted to a system that includes more or fewer materials than those shown in FIG. 6. The condition indicator 600 generally includes a detergent material indicator light element 605, a sanitizer material indicator light element 610, and a rinse aid material indicator light element 615 that correspond to the three materials. Additionally, in some embodiments, the condition indicator 600 includes a message display (e.g., an LCD or similar type of display). In other embodiments, the condition indicator 600 can include more or fewer lights (or other indicating components) than those shown in FIG. 6. For example, in some embodiments, the condition indicator 600 may include additional light elements (e.g., a plurality of different colored light elements). Alternatively, the condition indicator 600 may include fewer light elements (e.g., a single light element that changes color).

Generally, the light elements 605-615 can be used to indicate a condition of the dispensing system and/or a status of each material. For example, in one embodiment, as described in greater detail below, the light elements 605-615 change color according to the condition of the dispensing system. For example, a green light can indicate that the dispensing system is operating properly. However, if an error condition is identified, the light may change color to indicate to a user that an error condition is present.

For example, in one embodiment, after an error condition has been identified (e.g., a "blocked receptacle" condition), a yellow flashing light is used to indicate that the material dispensing system has been disabled (i.e., material will not be dispensed during a dosing period). In order to clear the error condition and continue with dispensing system operation, power to the dispensing system 100 may have to be removed and then restored. In other embodiments, the error condition may be cleared using another method, for example, with an input device located on the face of the condition indicator (e.g., a "clear fault" pushbutton).

In some embodiments, the dispensing system is not disabled until after a certain number of errors or faults have been identified, or after a predetermined time period has elapsed. For example, a controller can register and/or store identified error conditions as they are identified, and disable the dispensing system after three consecutive error conditions. Such embodiments can minimize disabling of the dispensing system due to faulty identified error conditions.

Figure 7:
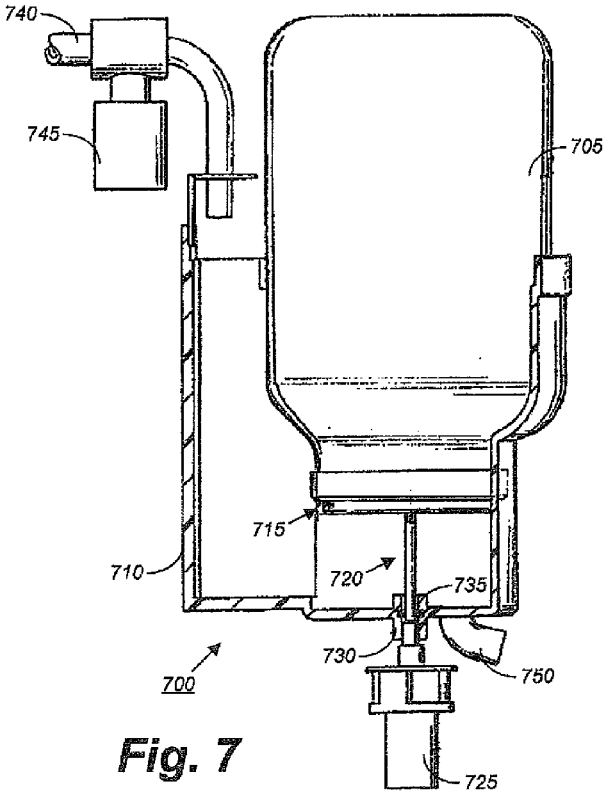
FIG. 7 illustrates an exemplary dispensing system according to an embodiment of the invention.

FIG. 7 illustrates an exemplary dispensing system 700 that can include or replace some components of dispensing system 100 of FIG. 1, not all of which are shown in FIG. 7. In some embodiments, the dispensing system 700 is configured to dispense or deliver a granulated material or powder (e.g., a chemical such as a detergent, a sanitizer, a rinse aid, etc.). For example, in some embodiments, a granular or powder material is delivered to a clothes washing machine. In other embodiments, a granular or powder material is delivered to a dish washing machine. In the embodiment shown in FIG. 7, the dispensing system 700 generally includes a granulated material or powder container 705 that is supported in a dispenser assembly or receptacle 710. The container 705 is closed on one end by a metering and dispensing closure 715, which, as described in greater detail with respect to FIG. 8, can deliver or dose a predetermined amount of material from the container 705 into the receptacle 710. For example, in one embodiment, the dispensing closure 715 is rotated by a drive shaft 720 to deliver the material. The drive shaft 720 is driven by a drive member 725, and is journalled in a collar 730 with a seal 735.

The dispensing system 700 also includes a water intake conduit 740 that is controlled by a solenoid valve 745. The water intake conduit 740 and solenoid valve 745 are utilized to introduce water into the receptacle 710. For example, in some embodiments, when the solenoid valve 745 is energized, water from the water intake conduit 740 is allowed to enter the receptacle 710. Alternatively, when the solenoid valve 745 is de-energized, water is prevented from entering the receptacle 710. In other embodiments, a valve mechanism other than the solenoid valve 745 may be used, such as one controlled by a stepper motor or pulse width modulation (PWM) controller. In these embodiments, a valve can have a number of set positions, such as closed, 25% open, 50% open, 75% open, and 100% open, up to as many as the chosen valve controller will allow.

A water solution outlet conduit 750 is also in communication with the receptacle 710. For example, the outlet conduit 750 allows water to exit the receptacle 710. In some embodiments, as described in greater detail below, water is mixed with dispensed material prior to exiting the receptacle 710 through the outlet conduit 750. In the embodiment shown in FIG. 7, liquid or solution is allowed to exit the receptacle 710 through the outlet conduit 750 relatively unobstructed. In other embodiments, the outlet conduit 750 may include a solenoid valve or other valve, similar to the solenoid 745.

In some embodiments, as described in greater detail below, the dispensing system 700 can also include electronic components such as a controller 106, one or more conductivity sensors 142, and one or more capacitance sensor assemblies 110. For example, in one embodiment, one or more conductivity sensors are positioned in the receptacle 710 to monitor the conductivity of the receptacle 710 (and the liquid disposed therein). In addition, in one embodiment, a capacitance sensor assembly 110 is fluidly coupled between the output of the water intake conduit 740 and the receptacle 710.

Figure 8:
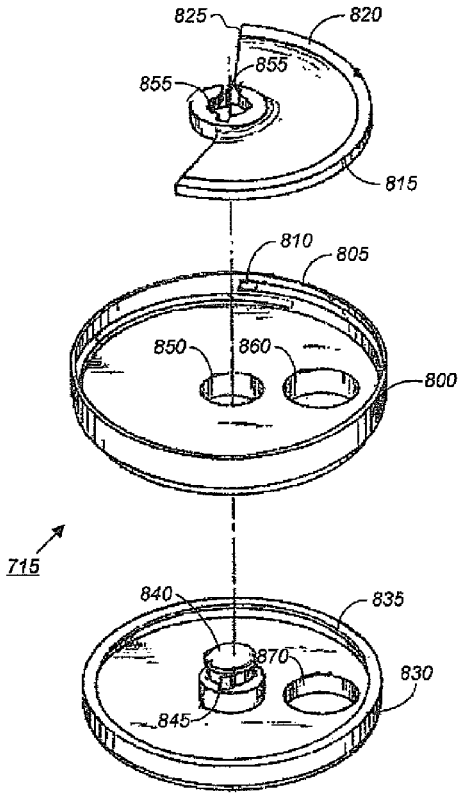
FIG. 8 illustrates an exemplary embodiment of a dispensing closure according to an embodiment of the invention.

As shown in FIG. 8, the metering and dispensing closure 715 is generally composed of three basic components. For example, the closure 715 generally includes a cap member 800 with an upstanding wall 805 and internal threads 810 for engaging complementary threads on the container 705. The second component is a rotatable disk 815 with a raised peripheral wall 820, as well as a cutaway portion 825. Rotatable disk 815 is configured to be seated inside the cap member 800. The third component is a rotatable disk 830 with a raised peripheral wall 835 and a stub shaft 840 with projections 845. These projections 845 fit through an opening 850 in the cap member 800 in a manner that the projections 845 engage slots 855 in the rotatable disk 815. Rotatable disks 815 and 830 are rotated by the shaft 720 (see FIG. 7) connected to the stub shaft 840.

Referring to FIGS. 7 and 8, in operation, the container 705 holding the material is supported in the receptacle 710. Water is introduced into the receptacle 710 through the water intake conduit 740. The metering and dispensing closure 715 is attached to the container 705. When the disks 815 and 830 of the closure 715 are properly aligned, the material from the container 705 is free to enter into a measuring opening or chamber 860 as it is uncovered by disk 815 and cutaway 825 (see FIG. 8). However, the material from the container 705 cannot pass into the receptacle 710, as the passage is blocked by rotatable disk 830. Activation of the drive member 725 and rotation of the drive shaft 720 causes the upper rotatable disk 815 and the lower rotatable disk 830 to move to a second position in which no more material can enter the opening 860, which has become a measuring chamber. Continued rotation of the disks 815 and 830 allows for the opening 860 to be positioned over opening 870, which allows the dose of material from the measuring chamber to flow into the receptacle 710 and be mixed with water from the intake conduit 740. The mixed material then exits the receptacle 710 through the water solution outlet conduit 750. In some embodiments, multiple doses are delivered during a single delivery cycle.

Figure 9:
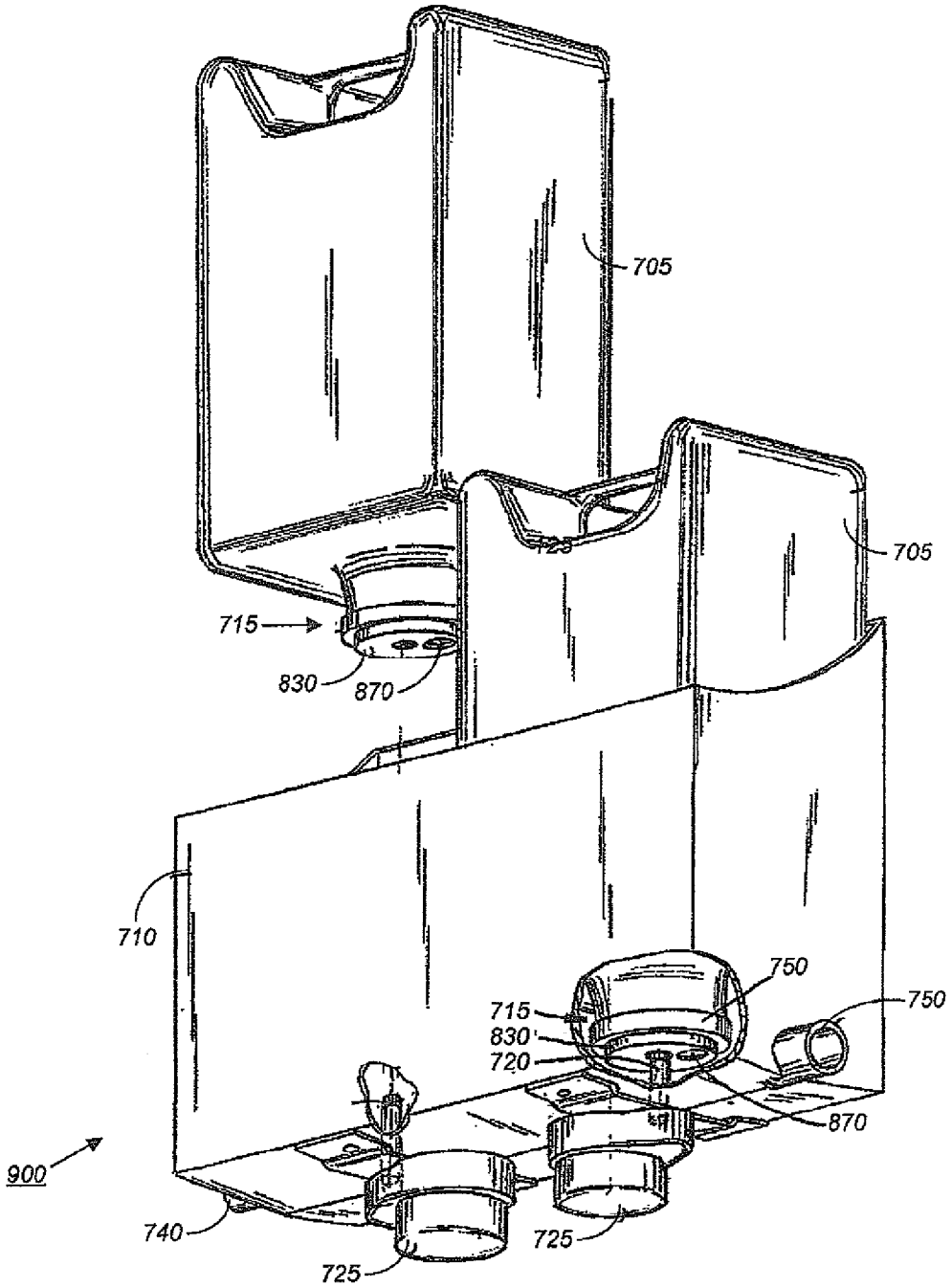
FIG. 9 illustrates an exemplary dispensing system according to another embodiment of the invention.
Figure 10:
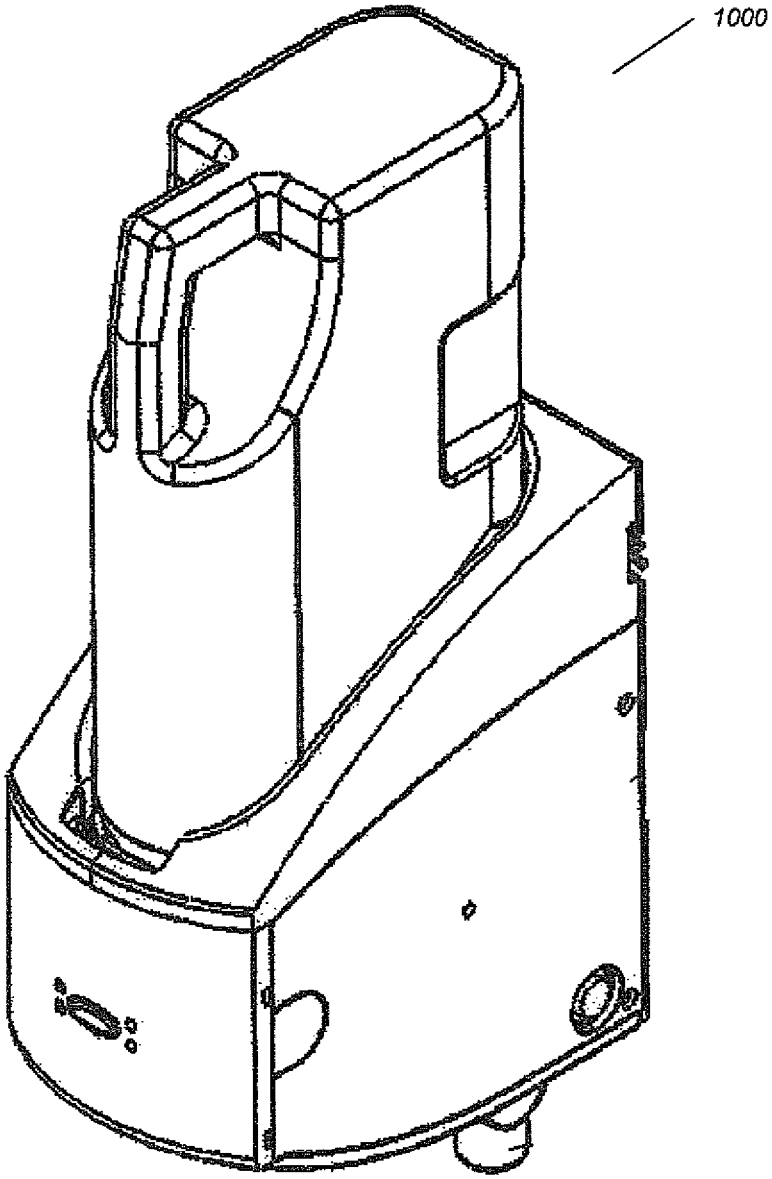
FIG. 10 illustrates an exemplary dispensing system according to yet another embodiment of the invention.

Referring to FIGS. 9 and 10, additional embodiments of dispensing systems are shown. In the embodiments shown in FIGS. 9 and 10, components similar to, or the same as, the components shown in FIGS. 7 and 8 are labeled with like numerals. For example, FIG. 9 illustrates a dispensing system 900 that includes two containers 705. In some embodiments, the separate containers 705 are utilized to introduce separate powder materials (e.g., a sanitizer and a detergent) to the water supply. FIG. 10 illustrates another embodiment of a dispensing system 1000 that includes an alternative type of container 705. The dispensing systems described with respect to FIGS. 7-10 are provided as exemplary systems only. It should be understood that the control methods described with respect to FIGS. 1-6 may be applied to a variety of dispensing systems. For example, in other embodiments, a dispensing system need not include a receptacle that contains water. An alternative dispensing system may utilize a separate portion that allows a material to be dropped into an additional container having a liquid predisposed therein. Additionally or alternatively, other liquids such as water miscible and immiscible solvents including water and ether could be employed in a dispensing system.

Thus, the invention provides, among other things, methods and systems of operating and controlling material dispensing systems. Various features and advantages of the invention are set forth in the following claims.

What is claimed is:

1. A capacitance sensor assembly for determining flow rate comprising:

a reservoir including an input passage, at least one retaining wall, wherein the retaining wall includes at least one opening, the opening having an opening size; and a fluid pooling area, wherein the input passage, fluid pooling area, and at least one opening are coupled such that the fluid pooling area can receive fluid from the input passage and fluid can exit the fluid pooling area through the at least one opening;

a capacitance sensor positioned within the fluid pooling area and including a capacitance level output operable to output a capacitance level signal indicative of a capacitance within the fluid pooling area; and a controller including a capacitance level input module coupled to the capacitance level output and operable to receive the capacitance level signal, and a flow rate module operable to indicate a flow rate of fluid exiting through the at least one opening based on the capacitance level signal and the opening size.

2. The capacitance sensor assembly of claim 1, wherein the capacitance sensor assembly is coupled to a material metering device configured to dispense a material into fluid that has exited through the at least one opening.

3. The capacitance sensor assembly of claim 2, wherein the capacitance sensor assembly and material metering device are coupled to a washing device.

4. The capacitance sensor assembly of claim 2, wherein the controller controls the material metering device to dispense the material based on a comparison of the flow rate of fluid exiting through the at least one opening and one or more stored flow rate threshold levels.

5. The capacitance sensor assembly of claim 1, wherein the controller is coupled to at least one conductivity sensor operable to indicate a conductivity level of fluid that has exited the at least one opening.

6. The capacitance sensor assembly of claim 5, wherein the controller controls the material metering device to dispense the material based on a comparison of the conductivity level of fluid that has exited the at least one opening and one or more stored conductivity levels.

7. The capacitance sensor assembly of claim 1, wherein the flow rate module is operable to determine the flow rate of fluid exiting through the at least one opening using at least one of the capacitance level signal as an index into a stored data table, and a formula including the capacitance level signal, the opening size, and a fluid pooling area size.

8. The capacitance sensor assembly of claim 1, wherein the flow rate is proportional to the capacitance level signal and the opening size.

9. A capacitance sensor assembly for determining flow rate comprising:

a reservoir including an input passage, a fluid pooling area positioned to receive fluid from the input passage, and an outlet opening through which fluid can exit the fluid pooling area;

a capacitance sensor in communication with the fluid pooling area and including a capacitance level output operable to output a capacitance level signal indicative of a capacitance within the fluid pooling area; and a controller including a capacitance level input module coupled to the capacitance level output and operable to receive the capacitance level signal, and a flow rate module operable to indicate a flow rate of fluid exiting through the outlet opening based on the capacitance level signal while fluid enters the fluid pooling area via the input passage and exits the fluid pooling area via the outlet opening.

10. The capacitance sensor assembly of claim 9, wherein the capacitance sensor assembly is coupled to a material metering device configured to dispense a material into fluid that has exited through the outlet opening.

11. The capacitance sensor assembly of claim 10, wherein the capacitance sensor assembly and material metering device are coupled to a washing device.

12. The capacitance sensor assembly of claim 10, wherein the controller controls the material metering device to dispense the material based on a comparison of the flow rate of fluid exiting through the outlet opening and one or more stored flow rate threshold levels.

13. The capacitance sensor assembly of claim 9, wherein the controller is coupled to a conductivity sensor operable to indicate a conductivity level of fluid that has exited the outlet opening.

14. The capacitance sensor assembly of claim 13, wherein the controller controls the material metering device to dispense the material based on a comparison of the conductivity level of fluid that has exited the outlet opening and one or more stored conductivity levels.

15. The capacitance sensor assembly of claim 9, wherein the flow rate module is operable to determine the flow rate of fluid exiting through the at least one opening using at least one of the capacitance level signal as an index into a stored data table, and a formula including the capacitance level signal, the opening size, and a fluid pooling area size.

16. The capacitance sensor assembly of claim 9, wherein the flow rate is proportional to the capacitance level signal and the opening size.

17. A method of determining a flow rate of a fluid in a capacitance sensor assembly having a reservoir including an input passage, a fluid pooling area positioned to receive fluid from the input passage, and an outlet opening through which fluid can exit the fluid pooling area, the method comprising:

determining a capacitance of fluid in the fluid pooling area and generating a capacitance level signal indicative of the capacitance of the fluid;

determining a flow rate of fluid exiting through the outlet opening based on the capacitance level signal while fluid enters the fluid pooling area via the input passage and exits the fluid pooling area via the outlet opening.

18. The method of claim 17, further comprising:

dispensing a material into fluid that has exited the through the outlet opening; and controlling material dispensation based on a comparison of the flow rate of fluid exiting through the outlet opening and one or more stored flow rate threshold levels.

19. The capacitance sensor assembly of claim 17, further comprising:

sensing a conductivity level of fluid that has exited the outlet opening, and controlling material dispensation based on a comparison of the conductivity level of fluid that has exited the outlet opening and one or more stored conductivity levels.

* * * * *